United States Patent [19]

White

[11] 4,264,320

[45] Apr. 28, 1981

[54] PRODUCTION OF BLACK FLAME-RESISTANT FLEXIBLE TEXTILE MATERIALS

[75] Inventor: Eric F. D. White, Alderly Edge, England

[73] Assignee: Fireproof Products Limited, Cayman Islands

[21] Appl. No.: 46,520

[22] Filed: Jun. 7, 1979

[30] Foreign Application Priority Data

Jun. 7, 1978 [GB] United Kingdom ..... 26476/78

[51] Int. Cl.[3] ..... C08K 3/28; C01B 31/00; D06M 13/44

[52] U.S. Cl. ..... 8/194; 8/116 P; 8/181; 8/195; 8/196; 8/196; 106/18.16; 106/18.18; 106/18.21; 106/18.22; 106/18.32; 106/18.33; 252/8.1; 252/423; 427/227

[58] Field of Search ..... 8/194, 195, 196; 427/227; 252/423; 106/15.05, 18.16, 18.18, 18.21, 18.22, 18.32, 18.33

[56] References Cited

U.S. PATENT DOCUMENTS

| | | | |
|---|---|---|---|
| 3,639,140 | 2/1972 | Miyamichi | 8/195 |
| 3,661,616 | 5/1972 | Miyamichi | 8/195 |
| 3,676,365 | 7/1972 | Shirai et al. | 252/423 |
| 3,702,832 | 11/1972 | Ermoleniko et al. | 252/423 |
| 3,803,056 | 4/1974 | Hart | 252/478 |
| 3,969,268 | 7/1976 | Fukada et al. | 252/423 |
| 4,110,509 | 8/1978 | Roth | 427/342 |

FOREIGN PATENT DOCUMENTS 1284415 8/1972 United Kingdom .

OTHER PUBLICATIONS

Miller et al. "Chars Produced From Cellulose under Various Conditions of Thermal Decomp" , J.P. Sci PTC #36, pp. 3-19, 1971.

*Primary Examiner*—Joseph L. Schofer
*Assistant Examiner*—Herbert J. Lilling
*Attorney, Agent, or Firm*—Bell, Seltzer, Park & Gibson

[57] ABSTRACT

Black, flame-resistant, substantially inert, non-conductive, flexible textile materials are produced by impregnating a scoured regenerated cellulosic textile material with a composition containing (a) a compound having in one tautomeric form, the general formula

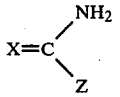

in which X is oxygen, sulphur or —NH—, and Z is $—NH_2$, —NHGN, $—NH.NH_2$, $—NH.CO.NH_2$ or lower alkyl or X and Z taken together represent a trivalent nitrogen atom, and (b) an ammonium salt of an oxy-acid of phosphorus, heating the impregnated textile in an oxygen-containing gas to a temperature of 220°-300° C. until a black, flame retardant product is obtained and there has been a loss in weight based upon the original weight of the textile material, of 20% to 30%.

11 Claims, No Drawings

PRODUCTION OF BLACK FLAME-RESISTANT FLEXIBLE TEXTILE MATERIALS

This invention relates to the production of a black, flame-resistant, substantially inert, non-conductive, flexible textile material.

The production of carbon and graphite fibres from various kinds of natural and synthetic fibres has been extensively investigated. One of the most useful sources of such fibres has proved to be cellulosic fibrous materials including cotton and the various regenerated celluloses. Such processes involve the carbonization of fibrous cellulosic materials. In one method of procedure it is possible to produce from the regenerated celluloses a black material which is flexible and retains the textile form of the material from which it is produced (see British Patent No. 986,637 and U.S. Pat. No. 3,235,323). This material has a higher carbon content than the cellulosic material from which it is derived (usually 54 to 61% by weight) and a significant nitrogen content (usually 3.1 to 5.8% by weight). In the production of this material regenerated cellulose fibres are impregnated with a water-soluble salt of a strong acid and a nitrogenous base which is capable of rendering the fibres non-flammable, dried and then heated in the dry state for a short time at a temperature in the range of 450°-600° F. in the presence of an oxygen-containing gas which is introduced at such a rate that the onset of a destructive exothermic reaction is avoided. The resulting material is inert towards the solvents in which regenerated celluloses are readily soluble. In the early stages of the process there is substantially complete loss of strength. With continued heating there is a regain of strength which may reach as high as 40% of the original strength of the fibres. Provided there is no movement of the fabric during the heat treatment the initial loss in strength is of little concern but the interesting properties of the products obtainable make it desirable that a continuous process of production should be available involving the continuous passage of the material undergoing treatment through a heated zone in which the desired dwell period is secured.

A somewhat similar process to that discussed above in which the black textile fibres contain a carbide of one of certain specified heavy metals is disclosed in U.S. Pat. No. 3,803,056. The presence of the heavy metal facilitates the reactions which occur in the fibres and in this case a sufficiently strong material can be obtained after a quite short sojourn in the heating zone. However the presence of heavy metals is not normally desirable in a material of this character.

The production of a weak product during the heat treatment of cellulose is also recognized in U.S. Pat. No. 3,661,616 which also comments on the slow heating procedures of the prior art. This patent recommends the use of ammonium salts of certain oxy acids of sulphur alone or a mixture of an organic nitrogenous base with (a) sulphuric, sulphurous or sulphamic acid or (b) an ammonium salt of certain oxy acids of sulphur as impregnants for the cellulosic material. The impregnated product is then heated in an oxydising atmosphere at a temperature within the range of 200°-350° C. and subsequently carbonised at higher temperatures. Heating prior to carbonisation in this case normally requires 3 to 4 hours. The nitrogenous bases used include urea and thiourea and their derivatives as well as simple aliphatic, aromatic and heterocyclic amines. Of these urea, guanidine and triethanolamine are reported to be the most effective. It is also proposed to include flame resistance imparting agents with the above noted acids and mixtures. Various levels of impregnation were tried. The presence of acidic hydrogen atoms in the impregnant gave a weaker product than that obtained when such hydrogen atoms had previously been neutralised. In a related U.S. Pat. No. 3,639,140 similar impregnating agents are used and the impregnated inert product heated in an inert atmosphere at temperatures of at least 400° C. prior to carbonisation. In this case also flame resistance imparting agents can be included in the impregnant. Heating prior to carbonisation in this case normally occupies 2½ to 5 hours. In both cases the loss of strength when heating the cellulosic fibres impregnated with impregnants comprising the ammonium salts of the oxy-acids of sulphur is reported to commence at 160°-180° C. whilst the subsequent increase in strength commences at temperatures above 180° C. and gives flexible fibres when the heat treatment has been taken to 280° C. It is emphasized that ammonium salts of various other acids including certain oxy-acids of phosphorus, nitric acid, hydrogen chloride and various organic acids reduce the strength of the treated fibres. This procedure, which is intended to produce fibres which are subsequently to be carbonised, is quite time consuming and requires times of 130 minutes or more prior to commencing the carbonisation. Dwell times of this order involve expenditure of a great deal of energy in maintaining the desired temperatures.

In British Specification No. 1,455,531 there is described a process for preparing active carbon fibres which comprises impregnating a cellulosic fibre with a phosphorus compound reactive therewith, subjecting the treated fibre to heat treatment at 200°-350° C. until the percentage decrease in the weight of the fibre is 40-75% based upon the initial weight of the cellulosic fibres and then treating the resulting material at 450°-1000° C. in an atmosphere containing not less than 5% by volume of steam until the percentage decrease in the weight of the fibre is 65-95%. A wide variety of fibres including regenerated cellulose fibres are proposed for use in this process whilst the phosphorus compound used may be an oxy-acid of phosphorus or a salt thereof. The phosphorus compound is intended to react with hydroxyl groups present in the cellulosic compound and the bond formed is broken down during the final stage of the process. In addition to the phosphorus compound a nitrogen-containing compound may additionally be present during the impregnation or a phosphorus compound containing a nitrogen atom may be used. The heat treatment at 200°-350° C. may be carried out in any atmosphere but a low concentration of oxygen is preferred. It is emphasized that at least a 40% loss in the weight of the fibre is necessary otherwise the absorbency of the final product is unsatisfactory. There is no mention in this specification of obtaining products possessing fire retardance; instead the whole emphasis is laid on obtaining products which are active carbon fibres useful as absorbents for deodorisation, decolorisation and refining.

It is accordingly an object of this invention to provide a process for the production of a black, flame-resistant, substantially inert, non-conductive, flexible textile material from a regenerated cellulosic material in which the initial loss of strength of the regenerated cellulose starting material is minimised and the heat treatment for the conversion of the regenerated cellulose into said black flexible material requires a relatively short time, e.g. less than 1 hour to complete the conversion. A further object is to produce materials which develop good flame retardancy properties within a relatively short time, preferable within not more than 30 minutes.

The present invention provides a process for the production of a black, flame-resistant, substantially inert, non-conductive flexible textile material by the action of heat in the presence of an oxygen-containing atmosphere upon cellulosic fibres which have been impregnated with a water-soluble salt of a strong acid characterised in that a regular regenerated cellulosic textile material which has been impregnated with (a) a compound having, in one tautomeric form, the general formula

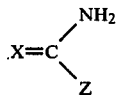

in which X is oxygen, sulphur or —NH— and Z is $—NH_2$, —NHCN, $—NHNH_2$, $—NHCONH_2$ or a lower alkyl group, or X and Z taken together represent a trivalent nitrogen atom, or a mixture of such compounds, and (b) an ammonium salt of an oxy-acid of phosphorus is used and that it is heated to a temperature of 220°–300° C. until a loss in weight, based upon the weight of the original textile material, of at least 20% but not more than 30% has occurred.

This invention has been developed from the observation that when a regular regenerated cellulose fabric is impregnated with a mixture of urea and diammonium hydrogen phosphate the decrease in strength which occurs when the impregnated material is heated to temperatures above 200° C. is markedly less severe than that hitherto reported. Minimum strengths of the order of 20°–25% of the initial strength, as determined on an Instron tester are readily obtainable. This makes it possible to process the impregnated material continuously and, since it is a relatively easy matter to impregnate and dry the material in a continuous process, the whole process can be carried out as one continuous process if this is desired.

The relative proportions in which urea and diammonium hydrogen phosphate are present affects the speed with which flame-retardency is developed. Thus an impregnant containing equal proportions by weight of urea and diammonium hydrogen phosphate develops good flame-retardancy in the product in a much shorter time than when the weight of urea is four times that of diammonium hydrogen phosphate with the total weight of impregnant being the same in both cases. In both cases however it is possible to secure a product having good flame retardency in less than 30 minutes and of adequate strength to enable it to be used for many purposes where fire retardancy is required.

Any kind of regular regenerated cellulose may be used in the process of the present invention. It may for example be a viscose rayon, a cuprammonium rayon or a regenerated cellulose rayon obtained by the hydrolysis of cellulose acetate fibres.

The process is particularly applicable to textile materials made from regular fibres of low denier number, e.g. from 1 to 5 denier. The higher the denier number the longer it takes to effect a satisfactory conversion to flame resistant material and the more difficult it becomes to effect a satisfactory impregnation.

In the present process one reactant is an ammonium salt of an oxy-acid of phosphorus and more especially an ammonium salt of ortho-phosphoric or pyrophosphoric acid having a neutral or acid reaction in aqueous solution (pH 7 or below), or a mixture of such salts. Salts of oxy-acids of sulphur are not used since their presence in the impregnant has been found to result in substantially complete loss of strength in the initial stages of heating the impregnated material; this is unacceptable for continuous processing and in any event, in our experience, does not give the results obtainable with the two component impregnants of the present invention.

The material to be processed may be in any of the conventional textile forms but it is most conveniently applied to woven materials, non-woven fabrics or felts. Regardless of the form employed it is important that the material to be treated be quite clean. To this end it is preferable to scour it thoroughly prior to impregnation. A convenient scouring bath is one containing 0.5 gm per liter of concentrated ammonium hydroxide and an equal amount of a non-ionic wetting agent. The material may be scoured with such a solution for 15–60 minutes at 50°–95° C.

After the material has been scoured it may be passed directly to the impregnating bath. Concentrations of impregnants of 10–35% by weight of the mixture of impregnating agents are conveniently employed using water as the solvent but higher or lower concentrations may be employed depending upon the controlled take up of solution at the nip. Such take up is conveniently 80–120% of the weight of the material being processed.

The next stage is to dry the impregnated material and this is conveniently effected by passage through an oven to which the impregnated material may pass directly from the impregnating bath. Drying is conveniently carried out at temperatures not exceeding 120° C. When the material is dry it is ready for treatment in the heating zone. At this stage it conveniently contains 10–35% of its dried weight of impregnant. Proportions outside this range are possible however depending upon the conditions employed in the subsequent heat treatment.

In the heat treatment the use of a freely circulating current of air or other oxygen-containing gas is required in order to ensure that the treatment proceeds smoothly and that a freely circulating gas atmosphere is constantly passing over the surfaces of the material undergoing heat treatment. This ensures uniformity in the treatment of the product. The proportion of oxygen in the gaseous atmosphere and the conditions of treatment should be so correlated as to avoid the onset of uncontrollable combustion. In our experience this is unlikely if the air or gas introduced contains less than 20% by volume of oxygen and the rate of replacement of the gas within the heat treatment zone is not unduly rapid. This should ensure that the oxygen content of the gas in the heated zone is between 5 and 15% by volume; it should be recognized however that oxygen content will vary to at least some extent as the treatment proceeds in the case of a batch operation but should remain fairly constant in a continuous operation if the whole of the heat treatment is carried out in a single zone. Insufficient change of gas or insufficient circulation can lead to an inferior product.

Two distinct phenomena appear to take place during the heat treatment. The first change is one which leads to an initial drop in the strength of the material being treated and the second is the development of flame retardant properties and recovery of strength. As already indicated the loss of strength in the initial stages of heating is much less pronounced when using the impregnant of the present invention than with the prior impregnants. With substantially the same overall weight of impregnant and the same fabric using respectively (a) a mixture of ammonium sulphate and diammonium hydrogen phosphate and (b) a mixture of urea and diammonium hydrogen phosphate the respective minimum strengths after 1–2 minutes processing at 260° C. have been found to be 0.5 kg/cm and 5.3 kg/cm. In the former case the salt of a weak base and a strong acid is present whilst in the latter case the diamide of a weak acid is used. The minimum strength using the latter impregnant is more than 10 times that obtained with the former impregnant under comparable conditions. The reason for this difference is not yet understood.

At temperatures below 250° C. the fall in strength to the minimum occurs more slowly and for instance at 237° C. is only reached after 5 minutes using the same urea-diammonium hydrogen phosphate impregnant as before. Conversely at temperatures above 260° C. it is reached in less than 2 minutes.

The recovery in strength and development of flame retardant properties occurs more slowly than the initial drop in strength. Recovery in strength proceeds somewhat more rapidly than the full development of flame retardant properties. Thus with the same impregnant as that used for the above tests and working at 260° C. strength reaches a maximum value after about 7.5 minutes but maximum flame retardance requires about 13 minutes to attain. The recovery in strength and development of flame retardant properties occur more slowly at temperatures below 260° C. and more rapidly at temperatures above 260° C. Thus temperatures of 280° C. or 300° C. can be employed and require shorter processing times thus making it possible to obtain higher output from a single unit of plant. Temperatures of 250° to 280° C. are preferred.

When a piece of fabric is treated as described above and allowed to cool it is found to possess good fire retardancy when exposed to a native flame. However, some reduction in strength then occurs. It is preferred to wash the material, which is quite flexible and black in appearance after completion of the heat treatment and cooling.

Instead of carrying out the heat treatment in a single zone it may be carried out in two or more zones operating at different temperatures. When this is done the first zone is operated at a somewhat lower temperature than that prevailing in the second and any subsequent zones. Thus the first zone may be operated at 230° C. and a second zone may operate at 260° C. or 270° C. In each zone a freely circulating current of air or other oxygen-containing gas is maintained.

With respect to the active ingredients present in the impregnating solution when using urea and diammonium hydrogen phosphate this may vary in proportions by weight from 10:1 to 1:1 but it is preferred that the proportions be from 4:1 to 1:1. A very convenient range of proportions which gives rapid development of flame retardance is from 2:1 to 1:2 by weight. Equal proportions by weight may be used.

Some derivatives of urea and other carboxamides have also given similar results. Such compounds have, in one tautomeric form, the general formula

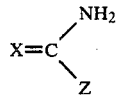

in which X is oxygen, sulphur or —NH—, and Z is $—NH_2$, —NHCN, $—NH.NH_2$, $—NH.CO.NH_2$ or lower alkyl or X and Z taken together represent a trivalent nitrogen atom.

In addition to urea the above general formula includes thiourea, guanidine, semicarbazide, biuret, dicyandiamide, cyanamide and the lower alkylcarboxamides, such as acetamide and propionamide. Those compounds which are normally markedly basic such as semicarbazide are conveniently used in the form of salts with sulphur-free, non-oxidizing acids, e.g. a salt with a hydrogen halide. In particular very useful results have been obtained with guanidine hydrochloride and semicarbazide hydrochloride. Interesting results have also been obtained with thiourea; in this case our tests indicate that the recovered strength is about 80% of that obtained under comparable conditions with urea whilst the flame retardancy is slower in developing.

Among the lower alkyl carboxamides, acetamide has also given particularly useful results, with residual strength and recovered strength of the same order as those obtained with urea and semicarbazide when treatment is carried out under the same conditions.

The general procedure is the same as that used with urea and the proportions of ingredients in the impregnants may be the same. The impregnated material is dried as previously described and the heat treatment may be carried out at the same temperatures as those described when urea is an impregnant. It is convenient that guanidine and semicarbazide can be used in the form of their commercially available sulphur-free salts. In the cases of biuret and dicyandiamide impregnation is carried out at raised temperatures owing to the sparing solubility of these substances in water at room temperature. Drying and heat treatment are carried out as already described. The times of heat treatment vary from compound to compound but our experience indicates that a few trials will readily indicate the times necessary to develop both maximum strength and flame retardancy in the treated material at any desired temperature. In general we prefer to use temperatures of 250° C. to 280° C. but somewhat higher temperatures, e.g. 300° C. are not excluded. Semicarbazide hydrochloride has given good results when used as an impregnant with diammonium hydrogen phosphate (weight proportions 4:1) at 250° C. and 260° C. It is not necessary to liberate the free base.

The following Examples illustrate the manner in which the invention may be carried into effect.

EXAMPLE 1

A woven, twill fabric (approximate weight 300 g/m$^2$; thread density: 16 threads/cm warp, 16 threads/cm weft) comprised of viscose rayon fibres (1.5 denier), was scoured in an aqueous solution containing ammonia (0.5 g/liter) and a non-ionic wetting agent, Synperonic N (0.5 g/liter) at 60° C. for 20 minutes. After rinsing in warm water the fabric was passed through pad-rollers, to remove excess moisture, and dried at 100° C.

The scoured fabric was soaked in a 25% concentration impregnating solution having the following composition:

Water: 75 parts by weight
Urea: 20 parts by weight
Diammonium hydrogen phosphate: 5 parts by weight for 30 minutes at 90° C., after which it was passed through pad-rollers, at a pressure of 45 kg/cm and then dried at 100° C. The fabric thus obtained contained 22% of solids, on a dry weight basis.

The thus treated fabric was subjected to a heat treatment in an air-circulating oven at 265° C. for 15 minutes. The resultant product was essentially black, with excellent flexibility and handling characteristics and was, before washing, about 77% of the weight of the scoured material used. This product retained about 40% of the tensile strength of the original twill fabric and was flame-retardant to an extent that surpassed the usual textile standards.

EXAMPLE 2

A lightly needled, felted cloth (weight 110 g/m$^2$) comprised of viscose rayon fibres (2.2 denier; 6 cm staple length) was scoured in the manner described in Example 1, and then soaked in the following impregnating solution:

Water: 75 parts by weight
Urea: 15 parts by weight
Diammonium hydrogen phosphate: 10 parts by weight for 40 minutes at 80° C. The thus soaked cloth was squeezed through pad-rollers, at a pressure of 35 kg/cm and then dried at 100° C., leaving a solids content of 30% on a dry weight basis.

Subsequently, the thus treated cloth was heat-treated in an air-circulating oven at 250° C. for 12.5 minutes. The resultant product was black in colour, lustrous in appearance and represented about 75% of the weight of the scoured material used. This product had excellent resistance to high temperatures and to the flame of a Bunsen burner.

EXAMPLE 3

The same viscose rayon fabric as described in Example 1 was scoured and dried in a similar manner to that described in that Example and then soaked in the following solution:

Water: 75 parts by weight
Acetamide: 20 parts by weight
Diammonium hydrogen phosphate: 5 parts by weight for 30 minutes at 90° C., after which it was passed through pad-rollers at a pressure of 45 kg/cm and dried at 90° C., leaving a solids content of 12.3% on a dry weight basis.

Subsequently, the thus treated fabric was heat-treated in an air-circulating oven at 250° C. for 30 minutes. The fabric produced was black and lustrous in appearance and was 73% of the weight of the scoured material used, with about 30% of the strength of the original twill and having excellent flame-retardant properties.

EXAMPLE 4

A needled, felted cloth (weight 204 g/m$^2$) comprised of viscose rayon fibres (4.5 denier) on a "Vinca", high modulus viscose rayon warp was scoured in the manner described in Example 1 and then soaked in the following solution:

Water: 75 parts by weight
Urea: 20 parts by weight
Diammonium hydrogen phosphate: 5 parts by weight for 30 minutes at 90° C., after which it was passed through pad-rollers at a pressure of 45 kg/cm and dried at 100° C. A solids content of 28%, on a dry weight basis, was left on the cloth.

Subsequently, the thus treated cloth was heat-treated in an air-circulating oven at 265° C. for 15 minutes. The resulting product was black in colour, lustrous in appearance and represented substantially 75% of the weight of the scoured material used. This product had excellent resistance to high-temperatures, including a Bunsen burner flame, blazing petrol and a hot metal nut at 900° C.

EXAMPLE 5

The same viscose rayon fabric as described in Example 1 was scoured and dried in a similar manner to that described in that Example and then soaked in the following solution:

Water: 75 parts by weight
Urea: 18.75 parts by weight
Diammonium hydrogen phosphate: 6.25 parts by weight for 30 minutes at 90° C., after which it was passed through pad-rollers at a pressure of 45 kg/cm and dried at 100° C., leaving a solids content of 30% on a dry weight basis. This dried, impregnated fabric had a tensile strength which was substantially 66% of that of the scoured fabric.

Subsequently, the thus treated fabric was heat treated in an air-circulating oven at 265° C. for 30 minutes. The resulting product was black, flexible and represented substantially 75% of the weight of the scoured material. This product retained substantially 45% of the tensile strength of the scoured material when tested on an Instron machine and had excellent resistance to high temperatures.

EXAMPLE 6

A woven, twill fabric (560 g/m$^2$) comprised of viscose rayon fibres (1.5 denier), was soaked in a solution having the following composition:

Water: 75 parts by weight
Urea: 20 parts by weight
Diammonium hydrogen phosphate: 5 parts by weight for 30 minutes at 90° C., after which it was passed through pad-rollers, at a pressure of 45 kg/cm, and then dried at 100° C. The fabric thus obtained contained 33% of solids on a dry weight basis.

Subsequently the thus treated fabric was subjected to a heat treatment in an air-circulating oven at 250° C. for 30 minutes. The resulting product was black in colour, flexible with excellent handling characteristics and was, before washing, substantially 75% of the weight of the starting material. This product retained substantially 40% of the tensile strength of the starting material and had excellent resistance to high temperatures.

EXAMPLE 7

A portion of the same viscose rayon fabric as that used in Example 1 was scoured and dried in a similar manner to that described in that Example and then soaked in the following solution:

Water: 68.4 parts by weight
Semicarbazide hydrochloride: 27.0 parts by weight

Diammonium hydrogen phosphate: 4.6 parts by weight for 20 minutes at 90° C., after which it was passed through pad-rollers at a pressure of 45 kg/cm and dried at 100° C., leaving a solids content of 46% on a dry weight basis on the fabric.

Subsequently the thus treated fabric was heat treated in an air circulating oven at 265° C. for 15 minutes. The product was black and lustrous in appearance and had relatively good handling characteristics. This product was substantially 76% of the weight of the scoured fabric and had 32% of the tensile strength of the latter as well as excellent flare-retardant properties.

MECHANICAL PERFORMANCE AND FIRE PROTECTION TESTS ON THE FABRICS OBTAINED

The behaviour of the fabrics obtained by the process of the invention has been tested according to various British Standard Specifications to ascertain their mechanical behaviour and their ability to withstand exposure to flame and transmission of heat. The material used was prepared as described in Example 1. The results of the various tests carried out were as follows:

(1) BS.3119—Method of Test for Flameproof Materials

This standard provides a method of test for determining whether a material is flameproof. This test involves applying a flame to the lower end of a vertically suspended strip of material for a period of 12 seconds and measuring the duration and extent of flaming of the specimen and the duration of the after-glow. On the washed twill weave fabric used for the test the following results were obtained:

(a) Duration of flaming: 0 seconds, the sample does not burn even while exposed to the flame.
(b) After-glow: No after-glow
(c) Length of material which chars or melts: None

(2) BS.3120—Performance Requirements of Materials for Flameproof Clothing

This specification specifies the performance requirements for materials for flameproof clothing, using the test procedures described in BS.3119. According to the above results the specimens of twill weave fabric submitted for test meets the requirements and can be described as "inherently flameproof".

(3) BS.3791—Clothing for Protection against intense Heat for Short Periods

This standard attempts to quantify the protection offered to the body by various items of protective clothing. Protective clothing and fabric assemblies for use in protective clothing should not ignite easily, should cease to burn when removed from an ignition source and should provide a high thermal insulative capacity to protect against high rates of heating.

Tests of the thermal protective index (flame) have been made as described in Appendix B of BS.3791. In this test a fabric assembly is exposed to burning hexane (simulating petrol) and the rate of temperature rise at the unexposed rear face of the fabric assembly is measured. The following experimental results were attained on samples of the treated fabric, treated felt and "Nomex":

| Sample Assembly | Time (sec) for stated temperature rises above ambient | | | | | |
|---|---|---|---|---|---|---|
| | 20° C. | 25° C. | 40° C. | 50° C. | 60° C. | 100° C. |
| Example 1/Example 1/ Viscose | 8.5 | 10 | 15.5 | 21.5 | 28 | 38 |
| "Nomex"/"Nomex"/ Viscose (comparative) | 6.5 | 8 | 11 | 13.5 | 19 | 26 |
| Example 1/Example 4 felt/Example 1 | 9.5 | 11.5 | 15.5 | 19.5 | 28 | 38 |
| Example 1/2 layers of Example 4 felt/ Example 1 | 12 | 14 | 21 | 30 | 38 | 53 |

The thermal protection index (flame) according to BS.3791 is the time in seconds for a rise in temperature of 25° C. to be recorded at the unexposed face of the sample.

In the case of the materials treated in accordance with the invention they remained intact even after one minute's exposure to the flame. The exposed layer of "Nomex" material burnt in the flame and disintegrated.

(4) BS.4700—Determination of Flammability of Textile Floor Coverings (Hot Nut Method)

This standard gives a method for assessment of the flammability of textile floor coverings by measuring the flammability, after-glow and extent of damage of a textile material when an M16 hexagonal nut (weighing 30 g) and at a temperature of 900° C. is placed in contact with the material for 30 seconds.

Two layers of twill weave fabric treated in accordance with the process of the invention were subjected to test. The results were as follows:

(a) Time for extinction of flame: 0 seconds, no combustion or smoke product were observed during contact of hot nut with sample or thereafter.
(b) Time of after-glow: 0 seconds. No after-glow observed.
(c) Size of affected area: The fabric sample remained intact. Very slight loss of strength of fabric in immediate contact with nut.

(5) BS.2576:1967—Breaking load and extension of strips of woven fabric

This test is designed to provide information of the strength and extensibility of fabrics which when coupled with experience of usage of fabrics indicate potential application areas.

The various tests were carried out on an Instron tensile testing machine at a constant crosshead speed of 5 cm/min on a gauge length of sample of 20 cm according to the specification. The following results were achieved as a mean of five individual conditioned samples.

| Treated Fabric | Mean Breaking Load (Kg/50 mm) | Mean Extension (%) |
|---|---|---|
| Warp direction | 36.0 | 8.1 |
| Weft direction | 18.7 | 24.1 |

(6) BS.4303:1968—The resistance to tearing of woven fabrics by the wing-rip technique The purpose of this test is to give a quantitative evaluation of the materials resistance to tearing in use. The test uses a 200×125 mm sample with a cut in it at which a tear then takes place in a controlled fashion.

An Instron testing machine operating with a cross-head speed of 10 cm/min was used for carrying out the test. The following results were achieved as a mean of tests on five conditioned samples of treated fabric.

| Treated Fabric | Mean Meridian tearing Resistance (Kg) | Mean Maximum Tearing Resistance (Kg) |
|---|---|---|
| Across warp direction | 1.47 | 1.86 |
| Across weft direction | 1.60 | 1.98 |

(7) BS.4768:1972—The Bursting Strength and Bursting Distension of Fabrics

This test allows a clamped circular fabric specimen to be distended by an elastic diaphragm until the sample ruptures; this gives an alternative indication of the strength of the fabric.

The measurements were carried out on a James Heald & Co., Model 111A burst strength tester on a 30 mm diameter conditioned sample. A diaphragm correction of 0.1 Kg/cm$^2$ was applied for this particular test machine. Ten samples were used for each determination; the mean bursting strengths and bursting extensions are reported.

| Treated Fabric | |
|---|---|
| Mean bursting strength | = 6.0 Kg/cm$^2$ |
| Mean bursting extension (estimated) | = 4 mm. |

We claim:

1. A process for the production of a black, flame-resistant, substantially inert, non-conductive flexible textile material which comprises impregnating a regular regenerated cellulosic textile material with a composition consisting essentially of (a) at least one compound having, in one tautomeric form, the general formula

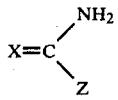

in which X is selected from O, S and —NH— and Z is selected from —$NH_2$, —NHCN, —$NHNH_2$, —NH-$CONH_2$ and lower alkyl groups or X and Z taken together represent a trivalent N atom, and (b) at least one ammonium salt of an oxy-acid of phosphorus, and thereafter heating the impregnated textile material in an oxygen-containing gas to a temperature within the range of 220° to 300° C. to effect a controlled oxidation thereof until a loss in weight, based upon the weight of the original textile material, within the range of 20 to 30% has occurred.

2. The process of claim 1 in which said regular regenerated cellulosic textile material comprises fibres of 1 to 5 denier.

3. The process of claim 1 in which said impregnated textile material is heated at a temperature within the range of 250° to 280° C.

4. The process of claim 1 in which said ammonium salt is an ammonium salt of ortho- or pyro- phosphoric acid having a pH under 7 in aqueous solution.

5. The process of claim 4 in which compound (a) is urea.

6. The process of claim 4 in which compound (a) is guanidine.

7. The process of claim 4 in which compound (a) is semicarbazide.

8. The process of claim 4 in which compound (a) is acetamide.

9. The process of claim 1 in which said impregnated textile material is continuously passed through a heated zone containing said oxygen-containing gas.

10. The process of claim 5 in which urea and diammonium hydrogen phosphate are used in the weight proportions of 4:1 to 1:1.

11. A black, flame-resistant, substantially inert, non-conductive flexible textile material which has been produced by a process which comprises impregnating a regular regenerated cellulosic textile with a composition consisting essentially of (a) at least one compound having, in one tautomeric form, the general formula

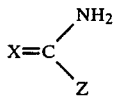

in which X is selected from O, S and —NH— and Z is selected from —$NH_2$, —NHCN, —$NHNH_2$, —NH-$CONH_2$ and lower alkyl groups or X and Z taken together represent a trivalent N atom, and (b) at least one ammonium salt of an oxy-acid of phosphorus, and thereafter heating the impregnated textile material in an oxygen-containing gas to a temperature within the range of 220° to 300° C. to effect a controlled oxidation thereof until a loss in weight, based upon the weight of the original textile material, within the range of 20 to 30% has occurred.

* * * * *